US005900356A

United States Patent [19]

Sato

[11] Patent Number: 5,900,356

[45] Date of Patent: May 4, 1999

[54] SILVER HALIDE COLOR PHOTOGRAPHIC MATERIAL

[75] Inventor: Minoru Sato, Minami-ashigara, Japan

[73] Assignee: Fuji Photo Film Co., Ltd., Kanagawa, Japan

[21] Appl. No.: 08/790,891

[22] Filed: Jan. 29, 1997

[30] Foreign Application Priority Data

Jan. 29, 1996 [JP] Japan ..... 8-012614

[51] Int. Cl.[6] ..... G03C 1/035; G03C 1/46; G03C 1/825

[52] U.S. Cl. ..... 430/506; 430/567; 430/510

[58] Field of Search ..... 430/567, 569, 430/506, 510

[56] References Cited

U.S. PATENT DOCUMENTS 4,435,501 3/1984 Maskasky ..... 430/434
4,463,087 7/1984 Maskasky ..... 430/567
4,888,272 12/1989 Kishida et al. ..... 430/569
5,272,052 12/1993 Maskasky ..... 430/569

FOREIGN PATENT DOCUMENTS 59-133540 7/1984 Japan ..... G03C 1/02

*Primary Examiner*—Mark F. Huff
*Attorney, Agent, or Firm*—Birch, Stewart, Kolasch and Birch, LLP

[57] ABSTRACT

A silver halide color photographic material comprising a blue sensitive emulsion layer unit, a green sensitive emulsion layer unit and a red sensitive emulsion layer unit provided on a support, at least one of said three color sensitive emulsion layer units containing at least three emulsion layers different from one another in sensitivity, in which all photosensitive layers of said three color sensitive emulsion layer units contain photosensitive tabular silver haloiodide grains having an aspect ratio of from two to 100 and said photosensitive tabular silver haloiodide grains contain grains each having a projection at at least one vertex thereof, whereby a color photographic material having excellent relation between sensitivity and granularity and improved push-processing suitability can be provided.

17 Claims, No Drawings

SILVER HALIDE COLOR PHOTOGRAPHIC MATERIAL

FIELD OF THE INVENTION

The present invention relates to a color photographic material, and particularly to a color photographic material excellent in the relationship between sensitivity and granularity and improved in push-processing suitability.

BACKGROUND OF THE INVENTION

In general, a color photographic material comprises color sensitive emulsion layer units having color sensitivity different from one another which are provided on a support, the units each containing at least one silver halide emulsion layer. (The color sensitivity herein means a nature to have sensitivity to any one of three regions of visible spectrum, that is, red, green and blue.

In the field of color photographic materials, and particularly, in the color reversal photographic materials which are frequently used by professional photographers, high-sensitivity color photographic materials are required to take sports photographs which need high shutter speed or to shoot particular scenes under insufficient quantity of light for exposure like stage photography. However, the high-sensitivity color photographic materials have coarse granularity, and therefore, improvement in the relation between sensitivity and granularity has been desired.

On the other hand, sensitivity adjustment owing to processing has also been conducted to compensate for underexposure. This sensitivity adjustment owing to processing is usually called "push-processing", and in the color reversal photographic materials, push-processing is done by extending the standard processing time in the first development (black-and-white development).

However, conventional color reversal photographic materials do not necessarily have sufficient push-processing suitability. In fact, the first development requires time much longer than the standard processing time to obtain high sensitivity in some cases, or in some photographic materials having a structure composed of two layers, a high sensitivity layer and a low sensitivity layer, different push-processing suitability of both the layers causes variation in gradation owing to the push-processing. An attempt to increase an extent of the push-processing by extending the first development time often results in a marked decrease in color image densities, or difference in the push-processing suitability among a red sensitive layer, a green sensitive layer and a blue sensitive layer causes deterioration in color balance in some cases.

Accordingly, the development of techniques for bringing about an excellent relationship between the sensitivity and the granularity and for obviating defects caused by the push-processing has been desired.

JP-A-51-128528 (The term "JP-A" as used herein means an "unexamined published Japanese patent application") (U.S. Pat. No. 4,082,553) discloses that a color reversal photographic material having silver halide emulsion layers which are studded with silver halide grains fogged at the surfaces thereof is improved in the interlayer effect. However, the surface-fogged silver halide grains should be differentiated from silver halide grains fogged in the interior thereof (claim (11) in JP-A-51-128528), and addition of such surface-fogged silver halide grains has an adverse effect on photographic properties in standard processing, and in addition, the disadvantage of markedly lowering densities of color images owing to the push-processing.

U.S. Pat. Nos. 2,996,382, 3,178,282 and 3,397,987 disclose that incorporation of both silver halide grains capable of forming surface latent images on exposure and silver halide grains containing internal fog nuclei into emulsion layers raises the sensitivity and the contrast of a negative image forming photographic element. However, these specifications give no description of push-processing, or conventional color reversal photographic materials at all. Further, in this photographic element, the silver halide grains having the surface latent images release a reaction product in response to exposure amounts during development after exposure, the reaction product generating cracks in the silver halide grains containing internal fog nuclei to make development possible. Therefore, this causes the sensitivity and the contrast to increase even in standard processing to make it impossible to control the sensitivity raised owing to the push-processing.

Further, it is described in JP-B-46-19024 (The term "JP-B" as used herein means an "examined Japanese patent publication") (U.S. Pat. No. 3,505,068) that, with a color reversal photographic material in which a color sensitive emulsion layer is composed of a high sensitivity layer and a low sensitivity layer, the contrast can be efficiently lowered, when silver iodide is used for the high sensitivity layer and grains in which cores consisting of silver haloiodide are covered with shells composed of a silver halide which contains no silver iodide at all are used for the low sensitivity layer. However, the core-shell type silver halide grains used herein exhibit no particular action on the push-processing, because they contain no fog nuclei in the interior thereof.

Further, JP-A-59-214852 discloses that, as a technique for yielding no variation in gradation and no deterioration in color balance and for controlling relatively small the extent of decrease in the densities of color images due to the push-processing, a silver halide emulsion containing fog nuclei in the interior thereof is incorporated into silver halide emulsion layers or layers adjacent to the silver halide emulsion layers, and these fog nuclei function in the push-processing to promote development. In this technique, the sensitivity of the emulsion layers into which a silver halide emulsion having fog nuclei in the interior thereof is incorporated increases on push-processing, and therefore the addition of this emulsion to the emulsion layers undergoing relatively limited extent of sensitization makes it possible to adjust color balance after the push-processing. However, when the sensitivity increase of a particular emulsion layer after the push-processing is extremely large, even incorporation of a large amount of the above-mentioned silver halide emulsion having fog nuclei in the interior thereof into the emulsion layers undergoing a limited extent of sensitization brings about insufficient sensitivity increase in some cases. In these cases, the push-processing gives no satisfactory color balance, and in addition, the incorporation of a large amount of the emulsion having fog nuclei in the interior thereof results in decrease in densities of color images.

On the other hand, colloidal silver is known to improve developing activity of the neighborhood more than the above-mentioned fogged emulsion. Photographic materials containing colloidal silver in emulsion layers or adjacent layers thereof are described, for example, in JP-A-60-126652, JP-A-63-304252, JP-A-2-110539, JP-A-3-113438, JP-A-3-226732, and U.S. Pat. No. 979,001. Of these patents, U.S. Pat. No. 979,001, JP-A-60-126652, JP-A-63-304252, JP-A-2-110539, and JP-A-3-113438 aim at improving image quality and gradation reproduction. Although JP-A-3-226732 refers to the push-processing suitability, it does not state at all that yellow colloidal silver gives high push-processing suitability, and an attempt to incorporate yellow colloidal silver into each layer adjacent to the color sensitive layers is not made. To put it shortly, the effect of colloidal silver on improvement in developing activity, that is, what colloidal silver should be used or how the colloidal silver should be incorporated into a photographic material, has never been examined in order to improve the push-processing suitability.

The process for preparing the tabular silver halide grains and the technique for using them are already disclosed, for example, in U.S. Pat. Nos. 4,434,226, 4,439,520, 4,414,310, 4,433,048, 4,414,306, and 4,459,353, JP-A-59-994335, JP-A-60-209445, and JP-A-63-151618. Some advantages are known about it, which include sensitivity increase including improvement in efficiency of color sensitization due to sensitizing dyes, good relationship between the sensitivity and the granularity, improvement in sharpness due to peculiar, optical nature of the tabular grains and improvement in covering power.

JP-A-59-133540 discloses a silver halide emulsion containing silver halide host grains which are mainly enclosed with {111} crystal faces and have an average aspect ratio smaller than 8:1 and a silver salt which is epitaxially located on selected surface sites of the host grains and substantially limited to the sites, in which the silver halide host grains contain the iodide in an amount insufficient for the epitaxial silver salt to be directed to the selected surface sites of the host grains. However, this specification gives no description of the push-processing which this silver halide emulsion may undergo.

It is mentioned in JP-A-63-244030 (corresponding to U.S. Pat. No. 4,888,272) that a photographic material in which silver halide grain substrates have projections on the surfaces thereof and the projections have silver halide composition different from that of the substrates so that the solubility of the projections in developing solution can be higher than the solubility of the substrates in developing solution provides enhanced sharpness without sensitivity decrease. It is revealed, however, that the flexibility to control of the push-processing is insufficient, because the solubility of the projections is much greater than that of the substrates so that the projections dissolve in processing solution in a short period of time.

SUMMARY OF THE INVENTION

An object of the present invention is to provide a color photographic material excellent in the relationship between sensitivity and granularity and improved in push-processing suitability.

As a result of intensive studies, the present inventors have achieved the object of the present invention by the following means (1) to (4):

(1) A silver halide color photographic material comprising a blue sensitive emulsion layer unit, a green sensitive emulsion layer unit and a red sensitive emulsion layer unit provided on a support, at least one of said three color sensitive emulsion layer units containing at least three emulsion layers different from one another in sensitivity, in which all photosensitive layers of said three color sensitive emulsion layer units contain photosensitive tabular silver haloiodide grains having an aspect ratio of from two to 100 and said photosensitive tabular silver haloiodide grains contain grains each having a projection at at least one vertex thereof.

(2) A silver halide color photographic material as described in (1), in which at least two units of the blue sensitive emulsion layer unit, the green sensitive emulsion layer unit and the red sensitive emulsion layer unit each contains at least three emulsion layers different from one another in sensitivity.

(3) A silver halide color photographic material as described in (1), in which a layer containing colloidal silver is formed adjacent to at least one lowest sensitivity layers of said three color sensitive emulsion layer units.

(4) A silver halide color photographic material as described in (1), in which at least one of said three color sensitive emulsion layer units has an emulsion layer containing a silver iodobromide grains fogged at the surfaces and/or in the interiors thereof.

DETAILED DESCRIPTION OF THE INVENTION

In the present invention, all color sensitive layers contain photosensitive tabular silver haloiodide grains having an aspect ratio of from two to 100.

The tabular silver halide grain (Hereinafter referred to as the "tabular grain") means a silver halide grain which has two opposite major faces parallel to each other and an equivalent-circle diameter (diameter of a circle having the same area as the projected area of the major face) longer than two times the distance between the major faces (that is, the thickness of the grain).

The aspect ratio used in the present invention is defined as an equivalent-circle diameter divided by a thickness of a grain, the diameter being determined by a method described later.

In the present invention, the aspect ratio of the tabular grains in the emulsions are from two to 100, preferably three or more, and particularly preferably five or more. The aspect ratio exceeding 100 results in deteriorations in resistance to damage by pressure and production suitability.

The equivalent-circle diameter of the tabular grains of the present invention is from 0.1 to 5.0 $\mu$m, preferably from 0.1 to 4.0 $\mu$m, and further preferably from 0.2 to 3.0 $\mu$m.

The thickness of the grains is from 0.03 to 0.5 $\mu$m, and preferably 0.03 to 0.3 $\mu$m.

In the present invention, the diameter and thickness of the grains are measured with the aid of electron photomicrographs by a method described in U.S. Pat. No. 4,434,226.

The tabular grains of the present invention are desired to form a monodispersion in which the coefficient of variation in a grain size distribution is preferably 30% or less, further preferably 20% or less, and most preferably 10% or less. The coefficient of variation used herein is represented by a value of a variation in grain size calculated on the basis of the equivalent-circle diameter and thickness of the tabular grains (standard deviation) divided by an average grain size, and further multiplied by 100. The grain size (R $\mu$m) is calculated according to the following formula by use of the equivalent-circle diameter (r $\mu$m) and the thickness (d $\mu$m) of a tabular grain:

$$R=(3r^2d/2)^{1/3}$$

A grain size distribution in a silver halide emulsion consisting of silver halide grains which have almost uniform shapes and small variations in grain sizes is an almost normal distribution and the standard deviation can be readily found.

As to the halogen composition of the tabular grains, it is preferable and important that the content of silver iodide is 0.2 mol% or more, and silver iodobromide, silver iodochloride and silver iodobromochloride, which contain silver iodide, are called silver/haloiodide. The content of silver iodide is more preferably from 0.5 to 8.0 mol %, and further preferably from 1.0 to 5.0 mol %.

The tabular grain may have uniform halogen composition in the whole grain or may be composed of two or more phases different in halogen composition. For example, when silver iodobromide is used, the silver iodobromide tabular grain may have a layer structure composed of a plurality of phases different in iodide content. Examples of preferred halogen composition of the tabular silver halide grain and halogen distribution in the grain are described in JP-A-58-113927, JP-A-58-113928, JP-A-59-99433, JP-A-59-119344, JP-A-59-119350, etc.

The tabular grains can be selected from among those formed of {111} crystal faces, {100} crystal faces, and mixed crystal faces of {111} and {100} crystal faces.

As to the latent image formation sites of the tabular grains, either grains in which the latent images are mainly formed on the surfaces thereof or grains in which the latent images are mainly formed in the interiors thereof can be used. Further, grains in which the latent images are simultaneously formed on the surfaces and in the interiors thereof may also be used.

The preparation of the tabular silver halide grains can be accomplished by appropriate combinations of procedures known to the industry. For example, seed crystals in which the tabular grains occupy 40% by weight or more thereof are formed in an atmosphere having a relatively low pBr value of 1.3 or less and are allowed to grow by adding simultaneously a silver solution and a halogen solution while maintaining the pBr at a similar value to above, thus preparing the tabular silver halide grains.

It is desirable that the silver and halogen solutions are added so as not to generate new crystal nuclei in course of the growth of the grains.

The size of the tabular silver halide grains can be adjusted by the control of temperature, the selection of the kind and volume of solvent and the control of the rate of addition of a silver salt and a halide during the growth of the grains.

The grain size, the grain shape (diameter/thickness ratio, etc.) the grain size distribution, and the rate of growth of the grains can be controlled, as needed, by use of a solvent for silver halides on preparing the tabular silver halide grains of the present invention.

For example, with increasing quantity of the solvent, the grain size is monodispersed and the rate of growth can be accelerated. On the other hand, increase in quantity of the solvent also shows a tendency to increase the thickness of the grains. Ammonia, thioethers, or thioureas is frequently used as the solvent for silver halides.

These solvents for silver halides are added on preparing the tabular silver halide grains of the present invention to promote the growth of the grains. Methods of increasing the rate of addition, the volume added, or the concentrations of a silver salt solution (for example, aqueous $AgNO_3$ solution) and a halide solution (for example, aqueous KBr solution) are preferably used for the same purpose.

The tabular silver halide grains and the silver halide emulsions containing these tabular grains, and more specifically, processes for preparing them, which can be used in the present invention, are described, for example, in U.S. Pat. Nos. 4,434,226, 4,439,520, 4,414,310, 4,425,425, 4,399,215, 4,435,501, 4,386,156, 4,400,463, 4,414,306, and 4,425,426, EP-A-84637, JP-A-59-99433, *Research Disclosure*, No.22534 (January, 1983), etc.

In the present invention, the following monodisperse hexagonal tabular grains can be employed. The silver halide emulsion comprises a dispersion medium and silver halide grains, and 70% or more of the entire projected area of said silver halide grains are occupied by the tabular silver halide grains hexagonal in shape which have a ratio of the length of the longest side to that of the shortest side of two or less and have two surfaces parallel to each other. Further, said hexagonal tabular silver halide grains exhibit monodispersibilities with 20% or less in coefficient of variation in grain size distribution [a value of variation in grain size represented by the equivalent-circle diameter (standard deviation) divided by an average grain size], and have aspect ratios of 2.5 or more, and grain sizes of 0.2 $\mu$m or more.

Said hexagonal tabular grains may be formed of any of silver bromide, silver iodobromide, silver chlorobromide, and silver chloroiodobromide. When iodide ion is contained, the content thereof is from 0 to 30 mol %. The grains may have either a uniform halogen composition or different compositions at the internal and external portions thereof, and may have a layer structure. It is preferred that the grains contain reduction-sensitized silver nuclei. Said silver halide grains can be prepared by way of nucleation, Ostwald ripening and growth of grains, which is described in JP-A-63-151618 in detail.

In the present invention, tabular grains into which dislocations are intendedly introduced as described in JP-A-63-220238 can be used for the tabular silver halide emulsions.

The tabular silver halide grains can be used as a monodispersion in dispersibilities of the grain diameter and/or thickness thereof as described in JP-B-47-11386, etc.

The monodispersion formed by the tabular silver halide grains herein means a dispersion system in which 95% of the grains are in size within ±60%, preferably within ±40%, and further preferably within ±25% of a number average grain size. The number average grain size used herein is a number average diameter based on the equivalent-circle diameters of the silver halide grains.

Polyalkylene oxide block copolymers described in U.S. Pat. Nos. 5,147,771, 5,147,772 and 5,147,773, and EP-A-513723 are preferably used to improve the monodispersibilities of the tabular grains.

The crystals in the emulsion of the present invention may have either a uniform halogen composition or different compositions at the internal and external portions thereof, and may have a layer structure. Furthermore, a mixture of grains having various crystal forms can be employed.

The above-mentioned emulsion may be of a surface latent image type in which latent images are mainly formed on the surfaces of the grains, of an internal latent image type in which latent images are mainly formed in the interiors of the grains, or of a type in which latent images are formed both on the surfaces and in the interiors of the grains. However, it is necessary to be a negative type emulsion. The internal latent image type emulsion may include a core/shell type internal latent image type emulsion as described in JP-A-63-264740. A process for preparing the core/shell type internal latent image type emulsion is described in JP-A-59-133542. Although the thickness of the shell of this emulsion varies depending upon processing or the like, it is preferably from 3 to 40 nm, and particularly preferably from 5 to 20 nm.

The tabular silver haloiodide emulsions which have been subjected to physical ripening, chemical ripening and spectral sensitization are usually employed. Additives used in these steps are described in *Research Disclosure*, Nos.17643, 18716 and 307105.

In the present invention, the photosensitive tabular silver haloiodide grain having a projection at at least one vertex thereof is defined with the aid of electron photomicrographs as follows; When the fundamental shape of a tabular silver halide grain is hexagonal, a hexagon is drawn by prolonging a tangent line at the middle point of each side of the grain. The grain in which a vertex of the actual grain is projected out of the drawn hexagon is defined as the photosensitive tabular silver haloiodide grain having a projection. When a straight line linking center of gravity G of the drawn hexagon to a vertex A thereof intersects the edge of the actual grain at point B, distance AB is from 0.005 to 1 $\mu$m, preferably from 0.007 to 0.5 $\mu$m, and further preferably from 0.01 to 0.5 $\mu$m.

When the fundamental shape of a tabular silver halide grain is square or triangular, the definition referring to the above-mentioned hexagon can be similarly applied to them.

Although it is effective that each grain has one projection, each grain preferably has two or more projections, and most preferably has projections at all vertexes thereof.

The projection can be composed of any of silver chloride, silver bromide, silver iodide, silver iodobromide, silver chlorobromide, silver chloroiodide, and silver chlorobromoiodide. The content of silver chloride is preferably 50 mol % or less, and further preferably 20 mol % or less, and silver bromide, silver iodobromide and silver iodide, which do not contain silver chloride, are most preferred.

The proportion of the emulsion grains having the projections at vertexes in the tabular silver haloiodide grains of an emulsion layer is 10% or more, and preferably 20% or more.

Colloidal silver used in the present invention is required to have a maximum absorption wavelength in the region of from 400 to 500 nm, preferably from 430 to 460 nm, to assume an yellow color.

Processes for preparing various types of colloidal silver are described, for example, in Weiser, *Colloidal Elements*, Wiley & Sons, New York (1933) (yellow colloidal silver by Carey Lea's dextrin-reducing method); German Patent 1,096,193 (brown and black colloidal silvers); and U.S. Pat. No. 2,688,601 (blue colloidal silver). Of these colloidal silvers, the yellow colloidal silver having a maximum absorption wavelength in the region of 400 to 500 nm is particularly found to have an effect of affording the push-processing suitability. For example, addition of potassium iodide to the yellow colloid silver enables a maximum absorption wavelength to shift to a longer wavelength. However, in such a case, it happens that addition of colloidal silver markedly decreases the effect of improving the push-processing suitability, or utterly inhibits the effect in some cases. Like this, photographic properties of sensitized materials which markedly change depending upon the kinds or the colors of colloidal'silvers cannot have been expected at all, for example, from JP-A-60-126652, JP-A-63-304252, JP-A-2-110539, JP-A-3-113438, JP-A-3-226732, and U.S. Pat. No. 979,001.

In the present invention, it is necessary that the layers containing the yellow colloidal silver are adjacent to all of the blue sensitive emulsion layer, the green sensitive emulsion layer and the red sensitive emulsion layer. In the conventional photographic materials, particularly in the photographic materials for shooting, it is general that the blue sensitive layer, the green sensitive layer and the red sensitive layer are arranged in that order from the farthest layer from a support, the yellow colloidal silver functioning as a filter is placed between the blue sensitive layer and the green sensitive layer, and the black colloidal silver having the function of antihalation is placed between the red sensitive layer and the support. However, the black colloidal silver and the yellow colloidal silver are markedly different in effect of enhancing developing activity. Therefore, unless the yellow colloidal silver is incorporated into layers adjacent to all color sensitive layers, the photographic material deteriorates color balance when it is subjected to the push-processing.

In the present invention, it is necessary for the yellow colloidal silver to be added to layers adjacent to the blue sensitive emulsion layer, the green sensitive emulsion layer and the red sensitive emulsion layer. Incorporation of the yellow colloidal silver into the emulsion layers causes undesirable fog during storage or on processing of the photographic material. Addition of the yellow colloidal silver to layers nonadjacent to the color sensitive layers, for example, via interlayers, fails to bring about the effect of improving the developing activity.

In the present invention, it is preferred that the blue sensitive emulsion layer unit, the green sensitive emulsion layer unit and the red sensitive emulsion layer unit each comprise two or more layers different in sensitivity, color sensitivity (spectral sensitivity), or the like, and it is extremely preferred that the layers containing the yellow colloidal silver are adjacent to the lowest sensitivity layers of the color sensitive layer units. Although higher sensitivity layers often preferentially undergo development, the yellow colloidal silver layers adjoining to the lowest sensitivity layers enables the rates of development to be well balanced between the highest sensitivity layers and the lowest sensitivity layers, and variations in gradation owing to the push-processing can be reduced.

The above-mentioned effect is particularly remarkable, when all of the blue sensitive emulsion layer unit, the green sensitive emulsion layer unit and the red sensitive emulsion layer unit comprise three or more layers different from one another in sensitivity.

The total amount of coated silver exceeds 2 or more $g/m^2$ in a photographic material brings about a remarkable effect. Too much total amount of coated silver fails to sufficiently exhibit the effect of the yellow colloidal silver. The total amount of coated silver is preferably from 3 to 6 $g/m^2$, and further preferably from 4 to 5 $g/m^2$.

It has not utterly been expected that the effect of improving the rate of development owing to incorporation of the yellow colloidal silver into layers adjacent to sensitive layers varies depending upon the constitution of color sensitive layers in a photographic material or the amount of coated silver. However, such phenomenon can be understood, when assuming that the reason why the development of a lower sensitivity layer tends to be retarded is halogen ions released by developing higher sensitivity layers. That is, the effect of improving the rate of development owing to the yellow colloidal silver contained in the layers adjacent to low sensitive layers becomes larger with increasing the amount of coated silver halides which disturb the development of the low sensitivity layers or with increasing the number of high sensitivity layers compared to that of the low sensitivity layers.

In the present invention, the content of the yellow colloidal silver in each layer is preferably from 0.001 to 0.4 $g/m^2$, and further preferably from 0.003 to 0.3 $g/m^2$.

In the present invention, simultaneous use of the yellow colloidal silver and the silver halide grains fogged at the surfaces and/or in the interiors thereof enables the balance between the color sensitive layers in the push-processing to be more strictly controlled.

The silver halide grains fogged at the surfaces and/or in the interiors thereof used in the present invention are described below.

In the present invention, the silver halide grains fogged at the surfaces and/or in the interiors thereof mean silver halide grains which come to have fog nuclei on the surfaces and/or in the interiors thereof by a chemical method or by light and are prepared so as to be developed regardless of exposure.

The silver halide grains fogged at the surfaces thereof (surface-fogged type silver halide grains) can be prepared by fogging these silver halide grains during and/or after formation of the grains by a chemical method or by light.

The fogging can be performed by adding reducing agents or gold salts in appropriate pH and pAg ranges, by heating in a low pAg range, or by uniformly exposing to light. Examples of the reducing agents include stannous chloride, hydrazine type compounds, ethanolamine, and thiourea dioxide. The fogging with these fogging agents is preferably conducted before the water-washing step to prevent aging fog due to dispersion of the fogging agents into photosensitive emulsion layers.

The silver halide grains fogged in the interiors thereof (internally fogged type silver halide grains) are prepared by forming shells on the surfaces of these surface-fogged type silver halide grains which act as cores. The internally fogged silver halide grains are described in detail in JP-A-59-214852. In these internally fogged type silver halide grains, the effect of the push-processing can be adjusted by controlling the thickness of the shells.

Further, the internally fogged silver halide grains can also be prepared by forming cores using the above-mentioned fogging procedure from the beginning of formation of grains followed by covering the cores with unfogged shells. It also is possible to fog silver halide grains all the way from the interiors to the surfaces thereof, if necessary.

Although these fogged silver halide grains may be composed of any of silver chloride, silver bromide, silver chlorobromide, silver iodobromide, and silver chloroiodobromide, silver bromide or silver iodobromide is preferred. In the iodobromide, the iodide contents is preferably 5 mol % or less, and further preferably 2 mol % or less. Further, these fogged silver halide grains may contain a structure different in halogen composition in the interiors thereof.

In the present invention, although the average grain size of the fogged silver halide grains is not particularly limited, it is preferred that the average grain size of these fogged silver halide grains incorporated into photosensitive silver halide emulsion layers or light-insensitive layers is smaller than the average size of the silver halide grains contained in the lowest sensitivity layers adjacent to those layers. Concretely, the average size of the fogged silver halide grains is preferably 0.5 $\mu$m or less, more preferably 0.2 $\mu$m or less, and most preferably 0.1 $\mu$m or less.

The shape of these fogged silver halide grains is not particularly limited, and either regular grains or irregular grains can be employed. Although the fogged silver halide grains may be polydisperse, they are preferably monodisperse.

These fogged silver halide grains can be added to arbitrary emulsion layers or interlayers. When added to the emulsion layers, they are preferably added to higher sensitivity layers rather than the lowest sensitivity layers. For example, in a color sensitive layer unit composed of three layers, it is preferred that the fogged silver halide grains are incorporated into the medium sensitivity layer or the highest sensitivity layer.

Although the content of the fogged silver halide grains can be changed as needed, the content is preferably from 0.05 to 50 mol %, and more preferably from 0.1 to 25 mol %, based on the total amount of photosensitive silver halides contained in the color photographic material of the present invention. From the viewpoint of the efficiency of fogging on the basis of the amount of silver used, the surface-fogged type silver halide grains smaller in the average size (concretely, 0.2 $\mu$m or less) are preferred.

However, the internally fogged emulsions are used for the adaptability of the proceeding of development and for the control of the rate of development, and it is preferred that the thickness of the shells of the internally fogged emulsions added to each layer are controlled so as to obtain a rate of development proper for the occasion.

In the photographic material of the present invention, the photosensitive layer units are generally arranged in the order of a red sensitive emulsion layer unit, a green sensitive emulsion layer unit and a blue sensitive emulsion layer unit from a support side. However, this arrangement may be reversed as needed, or it also is possible to insert a photosensitive layer having the different color sensitivity into photosensitive layers having the same color sensitivity in some cases.

Light-insensitive layers such as various interlayers can be provided between the above-mentioned silver halide photosensitive layers and on the uppermost layer or the lowermost layer.

Such interlayers may contain couplers or DIR compounds as described in JP-A-61-43748, JP-A-59-113438, JP-A-59-113440, JP-A-61-20037, and JP-61-20038, or may contain color mixture preventives as used usually.

When each photosensitive emulsion layer unit is composed of two silver halide emulsion layers, a high sensitivity emulsion layer and a low sensitivity emulsion layer, as described in German Patent 1,121,470 or British Patent 923,045, it is preferred that the emulsion layers are arranged so that lower sensitivity emulsion layers are closer to a support. Furthermore, the low sensitivity emulsion layer may be arranged on the side far from the support, whereas the high sensitivity emulsion layer may be arranged on the side close to the support, as described, for example, in JP-A-57-112751, JP-A-62-200350, JP-A-62-206541, and JP-A-62-206543.

Concretely, the photosensitive emulsion layers can be arranged, from the side farthest from a support, in the order of a low sensitivity blue sensitive layer (BL), a high sensitivity blue sensitive layer (BH), a high sensitivity green sensitive layer (GH), a low sensitivity green sensitive layer (GL), a high sensitivity red sensitive layer (RH), and a low sensitivity red sensitive layer (RL); in the order of BH, BL, GL, GH, RH, and RL; in the order of BH, BL, GH, GL, RL, and RH; or the like.

Further, the photosensitive emulsion layers can be arranged, from the side farthest from a support, in the order of a red sensitive layer, GH, RH, GL, and RL as described in JP-B-55-34932. Furthermore, they can be arranged in the order of a blue sensitive layer, GL, RL, GH, and RH from the side farthest from a support as described in JP-A-56-25738 and JP-A-62-63936.

The following arrangement is very preferably used in the present invention. That is, in the structure composed of three layers different from one another in sensitivity, the three layers are arranged from a higher sensitivity layer to a lower sensitivity layer toward a support, that is, the highest sensitivity layer forms a upper layer, the medium sensitivity layer a middle layer, and the low sensitivity layer a bottom layer as described in JP-B-49-15495. However, in such structure composed of three layers different from one another in sensitivity, it also is possible that the three layers in the same color sensitivity layer unit may be arranged in the order of the medium sensitivity emulsion layer, the high sensitivity emulsion layer and the low sensitivity emulsion layer from the side far from the support as described in JP-A-59-202464.

In addition, for example, arrangements such as the order of the high sensitivity emulsion layer, the low sensitivity emulsion layer and the medium sensitivity emulsion layer, or the order of the low sensitivity emulsion layer, the medium sensitivity emulsion layer and the high sensitivity emulsion layer can be permitted.

To improve color reproduction, donor layers (CL) which exhibit the interlayer effect different in spectral sensitivity distribution from main photosensitive layers such as BL, GL, or RL are preferably provided adjacent to or close to the main photosensitive layers as described in U.S. Pat. Nos. 4,663,271, 4,705,744 and 4,707,436, JP-A-62-160448, and JP-A-63-89850.

As mentioned above, various structures and arrangements of the layers can be selected according to the uses of photographic materials. Internal latent image type emulsions are very preferably used for the layers adjacent to the yellow colloidal silver-containing layers.

In the photographic material of the present invention, two or more emulsions different in at least one of characteristics of grain size, grain size distribution, halogen composition, shape of grains, and sensitivity can be mixed in one layer.

In the present invention, an emulsion comprising readily soluble grains (these grains are formed of silver salts having substantially higher solubility than silver iodide) can be blended as well as the above-mentioned tabular grain silver haloiodide emulsion and silver iodide finely divided grain emulsion.

Silver salts useful for this purpose can be selected from among those having a solubility product of from 9.5 to less than 16. Such silver salts preferably have a solubility product of from 9.75 to 15.5, and most preferably from 11 to 13. The values of these solubility products are those at a temperature of 20° C., unless otherwise indicated. The investigation of the solubility products referring to typical silver salts and the examples thereof are described, for example, in James, *Theory of the Photographic Process*, 4th Ed., Macmillan, 1977, Chapter 1, Sections F, G and H, pp.5–10.

For example, it is preferred that, when blended with photosensitive tabular silver bromoiodide grains, the readily soluble emulsions are substantially composed of silver bromide, silver thiocyanate, or combinations thereof, and that, when blended with photosensitive tabular silver chlorobromoiodide grains, the readily soluble emulsions are substantially composed of silver chloride or silver chlorobromide. The grain sizes thereof are preferably smaller than those of photosensitive tabular silver haloiodide grains, and concretely, 0.5 $\mu$m or less, and preferably 0.3 $\mu$m or less. Further, an average grain size less than 0.1 $\mu$m can be used. Therefore, the readily soluble emulsions can appropriately be Lipmann's emulsions used usually. Although the smallest average size is limited only by a convenience for preparing the grains, it is usually approximately 0.05 $\mu$m.

In the present invention, although the readily soluble emulsions can be used in arbitrary concentration to improve photographic properties of the reversal photographic material, the content thereof preferably ranges from 0.5 to 50 mol %, further preferably from 1 to 40 mol %, and most preferably from 2 to 20 mol % based on the total amount of silver in the mixed emulsion.

Various techniques and inorganic and organic materials used for the silver halide photographic emulsions and the silver halide photographic materials prepared from the emulsions which can be used in the present invention are generally described in *Research Disclosure*, No.308119 (1989) and No.37038 (1995).

In addition, examples of the techniques and the inorganic and organic materials usable for the color photographic materials to which the silver halide photographic emulsions of the present invention can be applied are more concretely described in the following portions of EP-A-436938 and patents cited below.

| | Items | Corresponding Portions |
|---|---|---|
| 1) | Silver Halide Emulsions Used Simultaneously | page 147, line 26 to page 148, line 12. |
| 2) | Yellow Couplers | page 137, line 35 to page 146, line 33; page 149, line 21 to line 23. |
| 3) | Magenta Couplers | page 149, line 24 to line 28; EP-A-421453, page 3, line 5 to page 25, line 55. |
| 4) | Cyan Couplers | page 149, line 29 to line 33; EP-A-432804, page 3, line 28 to page 40, line 2. |
| 5) | Polymer Couplers | page 149, line 34 to line 38; EP-A-435334, page 113, line 39 to page 123, line 37. |
| 6) | Colored Couplers | page 53, line 42 to page 137, line 34; page 149, line 39 to line 45. |
| 7) | Other Functional Couplers | page 7, line 1 to page 53, line 41; page 149, line 46 to page 150, line 3; EP-A-435334, page 3, line 1 to page 29, line 50. |
| 8) | Preservatives, Antifungal Agents | page 150, line 25 to line 28. |
| 9) | Formalin Scavenger | page 149, line 15 to line 17. |
| 10) | Other Additives | page 153, line 38 to line 47; EP-A-421453, page 75, line 21 to page 84, line 56; page 27, line 40 to page 37, line 40. |
| 11) | Processes for Dispersion | page 150, line 4 to line 24. |
| 12) | Supports | page 150, line 32 to line 34. |
| 13) | Membrane Thickness, Physical Properties of Membrane | page 150, line 35 to line 49. |
| 14) | Steps of Color Development, Black-and-White Development, and Fogging | page 150, line 50 to page 151, line 47; EP-A-442323, page 34, line 11 to line 54; page 35, line 14 to line 22. |
| 15) | Desilvering Step | page 151, line 48 to page 152, line 53. |
| 16) | Automatic Processors | page 152, line 54 to page 153, line 2. |
| 17 | Steps of Water-Washing and Stabilization | page 153, line 3 to line 37. |

The silver halide color photographic materials of the present invention tend to show more effectively the effect, when they are applied to film units equipped with a lens described in JP-B-2-32615 and JP-B-U-3-39784 (The term "JP-B-U" as used herein means an "examined Japanese utility model publication").

The present invention is illustrated by means of examples in great detail. However, the present invention is not limited by these examples.

EXAMPLE 1

(Preparation of Emulsion B-1)

To 1.6 liters of an aqueous solution containing 4.3 g of KBr and 7.5 g of bone gelatin having an average molecular weight (M) of 20,000, which was maintained at 40° C., 41 ml of an aqueous solution of silver nitrate (20.48 g of silver nitrate was contained in 100 ml of the solution) and 41 ml of an aqueous solution of potassium bromide and potassium iodide (14.3 g of potassium bromide and 2.7 g of potassium iodide were contained in 100 ml of the solution) were simultaneously added with stirring by the double jet method at a rate of 61.5 ml/minute, respectively. After aqueous gelatin solution (containing 35.6 g of inert gelatin and 284 ml of water) was added, the temperature of the resulting mixture was raised to 58° C. Aqueous silver nitrate solution (containing 2.4 g of silver nitrate) was added thereto over a 30-second period, and the resulting emulsion was subjected to ripening for 5 minutes.

Subsequently, an aqueous solution containing 47 g of silver nitrate (A) and an aqueous solution of potassium bromide were added to the emulsion over a 20-minute period while maintaining the emulsion at pAg 8.7.

After the reaction mixture was cooled to 40° C., an aqueous solution containing 8.6 g of silver nitrate and an aqueous solution containing 6.9 g of potassium iodide (C) were added thereto by the double jet method, and subsequently, an aqueous solution containing 164 g of silver nitrate (B) and an aqueous solution of potassium bromide were added thereto while maintaining the reaction mixture at pAg 9.2. Thereafter, the resulting reaction mixture was cooled to 35° C., and washed with water by the ordinary flocculation method. 77 g of gelatin were added to the emulsion, which was adjusted to pH 6.2 and pAg 8.8. The emulsion thus prepared contained tabular grains having an average equivalent-circle diameter of 0.25 $\mu$m, an average thickness of 0.05 $\mu$m, an aspect ratio of 5.0, and an average silver iodide content of 3.5 mol %.

The emulsion was heated to 62° C., and $7.15\times10^{-4}$ mol of a sensitizing dye given below was added thereto. After 10 minutes, $2.6\times10^{-5}$ mol/molAg of sodium thiosulfate, $1.1\times10^{-5}$ mol/molAg of N,N-dimethylselenourea, $3.0\times10^{-3}$ mol/molAg of potassium thiocyanate, and $8.6\times10^{-6}$ mol/molAg of chloroauric acid were added to the emulsion. The quantities of the sensitizing dye and chemical sensitizers, and the time of chemical ripening were adjusted so as to obtain the highest sensitivity at 1/100 second exposure.

Further, after compounds A-1 and A-4 given below were added, the tabular grains were covered by adding a finely divided grain emulsion containing 1.2 mol % of silver iodide with an average grain size of 0.08 $\mu$m, thus to prepare Emulsion B-1.

(Preparation of Emulsion B-2)

To 1560 ml of a 3.4% aqueous solution of gelatin maintained at 75° C., 800 ml of a 15% aqueous solution of silver nitrate and an aqueous solution containing potassium bromide at 0.85 mol/liter and potassium iodide at 0.031 mol/liter were added over a 50-minute period by the double jet method while maintaining the reaction mixture at pH 6.8 and silver electric potential (vs. SCE) +90 mV to prepare monodisperse cubic core grains having a side length of 0.27 $\mu$m. Subsequently, sodium chloroaurate as an gold sensitizer and compounds A-2 and A-3 given below in the respective amounts of 2.0 mg, 7.0 mg and 0.1 mg were added to the core grains, which was subjected to chemical sensitization at pH 6.8 and silver electric potential (vs. SCE) +100 mV for 40 minutes. After compounds A-1 and A-4 given below in the respective amounts of 0.14 g and 0.2 g were added thereto, the temperature was decreased to 50° C., and 200 ml of a 15% aqueous solution of silver nitrate, an aqueous solution containing potassium bromide at 0.85 mol/liter and potassium iodide at 0.004 mol/liter were again added to the sensitized emulsion over a 5-minute period at pH 6.8 and silver electric potential (vs. SCE) +10 mV to precipitate shells, thus obtaining final monodisperse cubic grains which have an average side length of 0.28 μm and an average silver iodide content of 3.5 mol %. This emulsion was passed through a ultrafiltration membrane to remove soluble silver salts, thus obtaining an internal latent image type emulsion (emulsion G) showing final pH 6.2 and pAg 8.4. The coefficient of variation in the grain size (side length) distribution (a value of standard deviation of the distribution divided by the average value and further multiplied by 100) of this emulsion was 8%, and the coefficient of variation in the silver iodide content distribution was 5%. The grains thus obtained had the crystal habit that {100} crystal faces occupy 99% and {111} crystal faces occupy 1%.

(Preparation of Emulsion B-3)

Emulsion B-3 was prepared similarly to emulsion B-1, except that at the end of chemical sensitization a AgBrI Lipmann emulsion (iodide content; 2.5 mol %, grain size: 0.06 μm) was added in an amount of 3% based on the amount of Ag of the mother emulsion and the ripening was extended by 20 minutes.

As a result, emulsion grains in which projections were deposited at the vertexes of emulsion B-1 having a fundamental shape of hexagon were obtained. When a straight line linking vertex A to center of gravity G of the fundamental hexagon intersects an edge (projecting portion) of the actual grain at point B (the procedure is described above), distance AB was 0.007 μm.

(Preparation of Emulsion F-3)

Emulsion F-3 was prepared by adding a AgBrI Lipmann emulsion to emulsion F-1 in a manner similar to that of emulsion B-3. Distance AB in emulsion F-3 was 0.009 μm.

(Preparation of the Other Emulsions)

The other emulsions were prepared by changing the formulations according to a conventional method on the basis of emulsion B-1 as to tabular emulsions or on the basis of emulsion B-2 as to normal crystal emulsions. The emulsions prepared were different in grain size, grain shape, AgI content, procedure of chemical sensitization, sensitizing dye, and method of addition as described in Tables 1, 2 and 3.

Preparation of Emulsion 101

A multilayer color photographic material, sample 201, was prepared by providing layers having the following compositions on a 127 μm-thick cellulose triacetate film support undercoated. The numbers show coating amounts per $m^2$. The effects of the added compounds are not limited to the uses described.

| 1st Layer: Antihalation Layer | |
|---|---|
| Black Colloidal Silver | 0.10 g |
| Gelatin | 1.90 g |
| Ultraviolet Absorbing Agent U-1 | 0.10 g |
| Ultraviolet Absorbing Agent U-3 | 0.040 g |

-continued

| | |
|---|---|
| Ultraviolet Absorbing Agent U-4 | 0.10 g |
| High Boiling Organic Solvent Oil-1 | 0.10 g |
| Finely Divided Solid Dispersion of Dye E-1 | 0.10 g |
| **2nd Layer: Interlayer** | |
| Gelatin | 0.40 g |
| Compound Cpd-C | 5.0 mg |
| Compound Cpd-J | 5.0 mg |
| Compound Cpd-K | 3.0 mg |
| High Boiling Organic Solvent Oil-3 | 0.10 g |
| Dye D-4 | 0.80 mg |
| **3rd Layer: Interlayer** | |
| Gelatin | 0.40 g |
| **4th Layer: Low-Sensitivity Red-Sensitive Emulsion Layer** | |
| Emulsion A-1 | 0.30 g (in terms of silver) |
| Emulsion B-1 | 0.20 g (in terms of silver) |
| Gelatin | 0.80 g |
| Coupler C-1 | 0.15 g |
| Coupler C-2 | 0.050 g |
| Coupler C-3 | 0.050 g |
| Coupler C-9 | 0.050 g |
| Compound Cpd-C | 5.0 mg |
| Compound Cpd-J | 5.0 mg |
| High Boiling Organic Solvent Oil-2 | 0.10 g |
| Additive P-1 | 0.10 g |
| **5th Layer: Medium-Sensitivity Red-Sensitive Emulsion Layer** | |
| Emulsion C-1 | 0.50 g (in terms of silver) |
| Gelatin | 0.80 g |
| Coupler C-1 | 0.20 g |
| Coupler C-2 | 0.050 g |
| Coupler C-3 | 0.20 g |
| High Boiling Organic Solvent Oil-2 | 0.10 g |
| Additive P-1 | 0.10 g |
| **6th Layer: High-Sensitivity Red-Sensitive Emulsion Layer** | |
| Emulsion D-1 | 0.40 g (in terms of silver) |
| Gelatin | 1.10 g |
| Coupler C-1 | 0.30 g |
| Coupler C-2 | 0.10 g |
| Coupler C-3 | 0.70 g |
| Additive P-1 | 0.10 g |
| **7th Layer: Interlayer** | |
| Gelatin | 0.60 g |
| Additive M-1 | 0.30 g |
| Color Mixture Preventive Cpd-I | 2.6 mg |
| Dye D-5 | 0.020 g |
| Dye D-6 | 0.010 g |
| Compound Cpd-J | 5.0 mg |
| High Boiling Organic Solvent Oil-1 | 0.020 g |
| **8th Layer: Interlayer** | |
| Silver Iodobromide Emulsion Fogged at the Surfaces and in the Interiors (Average Grain Diameter: 0.06 μm, Coefficient of Variation: 16%, AgI Content: 0.3 mol %) | 0.020 g (in terms of silver) |
| Gelatin | 1.00 g |
| Additive P-1 | 0.20 g |
| Color Mixture Preventive Cpd-A | 0.10 g |
| Compound Cpd-C | 0.10 g |
| **9th Layer: Low-Sensitivity Green-Sensitive Emulsion Layer** | |
| Emulsion E | 0.20 g (in terms of silver) |
| Emulsion F | 0.30 g (in terms of silver) |
| Gelatin | 0.50 g |
| Coupler C-4 | 0.10 g |
| Coupler C-7 | 0.050 g |
| Coupler C-8 | 0.10 g |
| Compound Cpd-B | 0.030 g |

-continued

| | |
|---|---|
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High Boiling Organic Solvent Oil-1 | 0.10 g |
| High Boiling Organic Solvent Oil-2 | 0.10 g |
| 10th Layer: Medium-Sensitivity Green-Sensitive Emulsion Layer | |
| Emulsion G-1 | 0.40 g (in terms of silver) |
| Gelatin | 0.60 g |
| Coupler C-4 | 0.070 g |
| Coupler C-7 | 0.050 g |
| Coupler C-8 | 0.050 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High Boiling Organic Solvent Oil-2 | 0.010 g |
| 11th Layer: High-Sensitivity Green-Sensitive Emulsion Layer | |
| Emulsion H-1 | 0.50 g (in terms of silver) |
| Gelatin | 1.00 g |
| Coupler C-4 | 0.20 g |
| Coupler C-7 | 0.10 g |
| Coupler C-8 | 0.050 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High Boiling Organic Solvent Oil-1 | 0.020 g |
| High Boiling Organic Solvent Oil-2 | 0.020 g |
| 12th Layer: Interlayer | |
| Gelatin | 0.60 g |
| Compound Cpd-L | 0.050 g |
| High Boiling Organic Solvent Oil-1 | 0.050 g |
| 13th Layer: Yellow Filter Layer | |
| Yellow Colloidal Silver | 0.070 g (in terms of silver) |
| Gelatin | 1.10 g |
| Color Mixture Preventive Cpd-A | 0.010 g |
| Compound Cpd-L | 0.010 g |
| High Boiling Organic Solvent Oil-1 | 0.010 g |
| Finely Divided Solid Dispersion of Dye E-2 | 0.050 g |
| 14th Layer: Interlayer | |
| Gelatin | 0.60 g |
| 15th Layer: Low-Sensitivity Blue-Sensitive Emulsion Layer | |
| Emulsion I-1 | 0.20 g (in terms of silver) |
| Emulsion J-1 | 0.30 g (in terms of silver) |
| Gelatin | 0.80 g |
| Coupler C-5 | 0.20 g |

-continued

| | |
|---|---|
| Coupler C-6 | 0.10 g |
| Coupler C-10 | 0.40 g |
| 16th Layer: Medium-Sensitivity Blue-Sensitive Emulsion Layer | |
| Emulsion K-1 | 0.60 g (in terms of silver) |
| Gelatin | 0.90 g |
| Coupler C-5 | 0.10 g |
| Coupler C-6 | 0.10 g |
| Coupler C-10 | 0.60 g |
| 17th Layer: High-Sensitivity Blue-Sensitive Emulsion Layer | |
| Emulsion L-1 | 0.40 g (in terms of silver) |
| Gelatin | 1.20 g |
| Coupler C-5 | 0.10 g |
| Coupler C-6 | 0.10 g |
| Coupler C-10 | 0.60 g |
| High Boiling Organic Solvent Oil-2 | 0.10 g |
| 18th Layer: The First Protective Layer | |
| Gelatin | 0.70 g |
| Ultraviolet Absorbing Agent U-1 | 0.20 g |
| Ultraviolet Absorbing Agent U-2 | 0.050 g |
| Ultraviolet Absorbing Agent U-5 | 0.30 g |
| Formalin Scavenger Cpd-H | 0.40 g |
| Dye D-1 | 0.15 g |
| Dye D-2 | 0.050 g |
| Dye D-3 | 0.10 g |
| 19th Layer: The Second Protective Layer | |
| Colloidal Silver | 0.10 mg (in terms of silver) |
| Finely Divided Grain Silver Iodobromide Emulsion (Average Grain Size: 0.06 μm, AgI Content: 1 mol %) | 0.10 g (in terms of silver) |
| Gelatin | 0.40 g |
| 20th Layer: The Third Protective Layer | |
| Gelatin | 0.40 g |
| Polymethyl Methacrylate (Average Grain Size: 1.5 μm) | 0.10 g |
| Methyl Methacrylate/Acrylic Acid Copolymer (4:6) (Average Grain Size: 1.5 μm) | 0.10 g |
| Compound Cpd-M | 0.030 g |
| Surfactant W-1 | 3.0 mg |
| Surfactant W-2 | 0.030 g |

Additives F-1 to F-8 were added to all emulsion layers, in addition to the above-mentioned components. Further, gelatin hardener H-1 and surfactants for coating and emulsification W-3, W-4, W-5, and W-6, as well as the above-mentioned components, were added to each layer.

Furthermore, phenol, 1,2-benzisothiazolin-3-one, 2-phenoxyethanol, phenetyl alcohol, and butyl p-benzoate were also added as preservatives and antifungal agents.

TABLE 1

| Emulsion | Characteristics of Grains | Equivalent-sphere Average Grain Size (μm) | Coefficient of Variation in Grain Size Distribution (%) | AgI Content (%) | AgI Content on the Surfaces of Grains (%) | Coefficient of Variation In AgI Content Distribution among Grains (%) | Ratio of Crystal Faces {111}/{100} |
|---|---|---|---|---|---|---|---|
| A-1 | Tabular Grains, Average Aspect Ratio: 5.0 | 0.20 | 25 | 3.5 | 3.5 | 60 | 97/3 |
| B-1 | Tabular Internal Latent Image Type Grains, Average Aspect Ratio: 5.0 | 0.25 | 25 | 3.5 | 3.0 | 30 | 99/1 |
| C-1 | Tabular Grains, Average Aspect Ratio: 8.0 | 0.31 | 25 | 3.0 | 1.5 | 20 | 99/1 |

TABLE 1-continued

| Emulsion | Characteristics of Grains | Equivalent-sphere Average Grain Size (μm) | Coefficient of Variation in Grain Size Distribution (%) | AgI Content (%) | AgI Content on the Surfaces of Grains (%) | Coefficient of Variation In AgI Content Distribution among Grains (%) | Ratio of Crystal Faces {111}/{100} |
|---|---|---|---|---|---|---|---|
| D-1 | Tabular Grains, Average Aspect Ratio: 8.0 | 0.52 | 10 | 1.6 | 1.0 | 8 | 99/1 |
| E-1 | Tabular Grains, Average Aspect Ratio: 3.5 | 0.15 | 30 | 4.0 | 3.5 | 50 | 95/5 |
| F-1 | Tabular Grains, Average Aspect Ratio: 5.0 | 0.25 | 25 | 4.0 | 3.0 | 30 | 98/2 |
| G-1 | Tabular Grains, Average Aspect Ratio: 8.0 | 0.33 | 15 | 3.2 | 2.5 | 10 | 99/1 |
| H-1 | Tabular Grains, Average Aspect Ratio: 10 | 0.68 | 8 | 2.8 | 2.0 | 10 | 99/1 |
| I-1 | Tabular Grains, Average Aspect Ratio: 5.0 | 0.27 | 20 | 4.6 | 3.0 | 35 | 97/3 |
| J-1 | Tabular Grains, Average Aspect Ratio: 8.0 | 0.45 | 15 | 4.6 | 2.3 | 30 | 98/2 |
| K-1 | Tabular Grains, Average Aspect Ratio: 8.0 | 0.45 | 8 | 2.0 | 1.3 | 20 | 99/1 |
| L-1 | Tabular Grains, Average Aspect Ratio: 10 | 0.81 | 8 | 1.0 | 0.5 | 15 | 99/1 |

TABLE 2

| Emulsion | Characteristics of Grains | Equivalent-sphere Average Grain Size (μm) | Coefficient of Variation in Grain Size Distribution (%) | AgI Content (%) | AgI Content on the Surfaces of Grains (%) | Coefficient of Variation In AgI Content Distribution among Grains (%) | Ratio of Crystal Faces {111}/{100} |
|---|---|---|---|---|---|---|---|
| B-2 | Cubic Internal Latent Image Type Grains | 0.28 | 8 | 3.5 | 2.0 | 30 | 1/99 |
| C-2 | Tetradecahedron Grains | 0.43 | 10 | 3.0 | 2.5 | 25 | 30/70 |
| G-2 | Cubic Grains | 0.53 | 8 | 3.2 | 1.5 | 15 | 1/99 |
| I-2 | Cubic Grains | 0.30 | 12 | 4.6 | 3.0 | 30 | 5/95 |
| J-2 | Tetradecahedron Grains | 0.53 | 8 | 4.6 | 3.0 | 40 | 50/50 |

TABLE 3

Spectral Sensitization of Emulsion A

| Emulsion | Sensitizing Dyes Added | Content per Mole of Silver Halide (g) | Time of Addition of Sensitizing Dyes |
|---|---|---|---|
| A-1 | S-3 | 0.025 | During Grain Formation |
| | S-2 | 0.40 | |
| | S-1 | 0.01 | |
| B-1 | S-3 | 0.01 | During Grain Formation |
| | S-2 | 0.40 | |
| C-1, 2 | S-3 | 0.01 | Before Chemical Sensitization |
| | S-2 | 0.30 | |
| | S-1 | 0.10 | |
| D-1 | S-3 | 0.01 | Before Chemical Sensitization |
| | S-2 | 0.15 | |
| | S-1 | 0.10 | |
| | S-8 | 0.01 | |
| E-1 | S-4 | 0.5 | Immediately After Grain Formation |
| | S-9 | 0.1 | |
| F-1 | S-4 | 0.40 | Immediately After Grain Formation |
| | S-9 | 0.1 | |
| G-1, 2 | S-4 | 0.30 | Before Chemical Sensitization |
| | S-5 | 0.08 | |
| | S-9 | 0.05 | |

TABLE 3-continued

Spectral Sensitization of Emulsion A

| Emulsion | Sensitizing Dyes Added | Content per Mole of Silver Halide (g) | Time of Addition of Sensitizing Dyes |
|---|---|---|---|
| H-1 | S-4 | 0.25 | Before Chemical Sensitization |
| | S-5 | 0.06 | |
| | S-9 | 0.05 | |
| I-1, 2 | S-6 | 0.07 | Immediately After Grain Formation |
| | S-7 | 0.45 | |
| J-1, 2 | S-6 | 0.05 | Immediately After Grain Formation |
| | S-7 | 0.30 | |
| K-1 | S-6 | 0.05 | Before Chemical Sensitization |
| | S-7 | 0.25 | |
| L-1 | S-6 | 0.04 | Before Chemical Sensitization |
| | S-7 | 0.20 | |

C-1
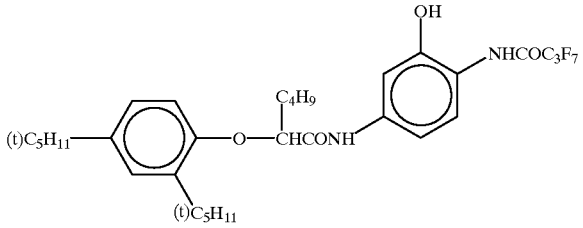
C-2
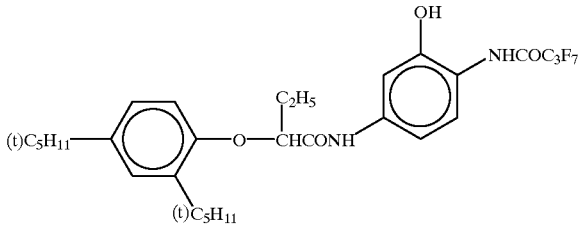
C-3
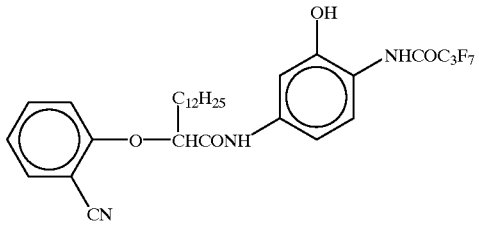
C-4
Average Molecular Weight: approximately 25,000
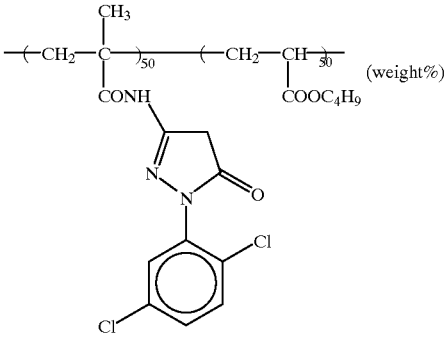
C-5
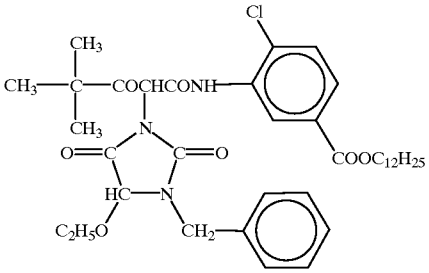

-continued
C-6
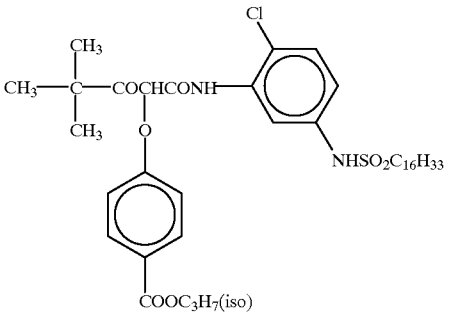
C-7
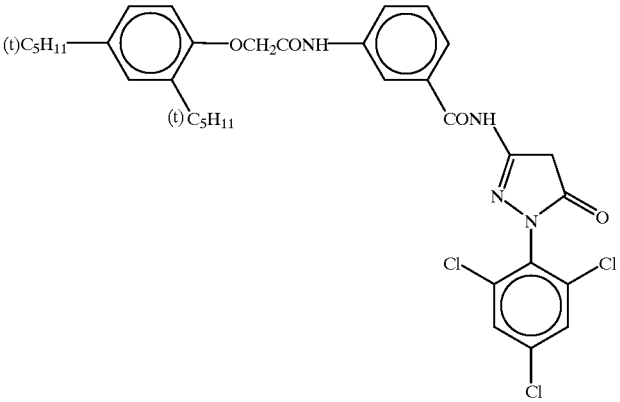
C-8
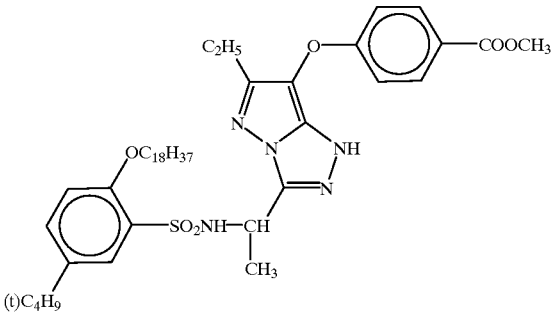
C-9
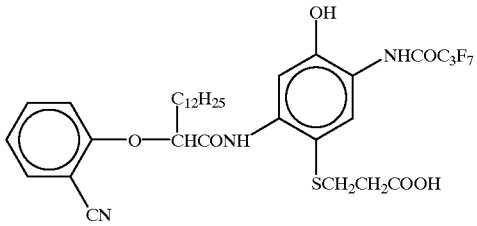
C-10
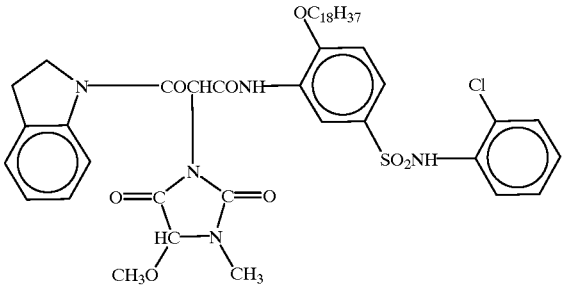
Oil-1
Dibutyl Phthalate
Oil-2
Tricresyl Phosphate -continued
Oil-3
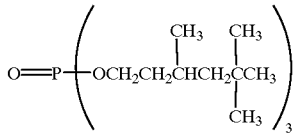
Cpd-A
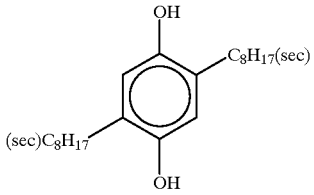
Cpd-B
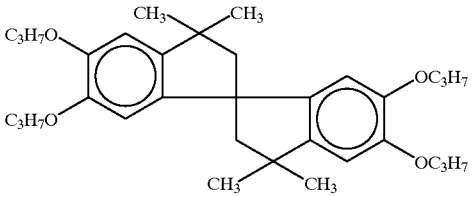
Cpd-C
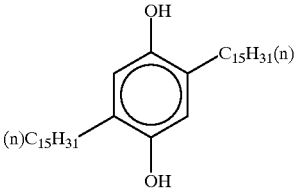
Cpd-D
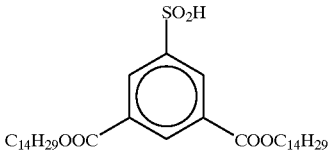
Cpd-E
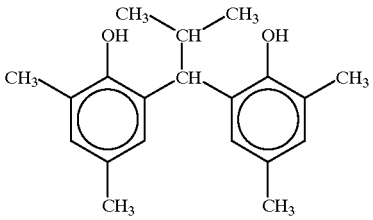
Cpd-F
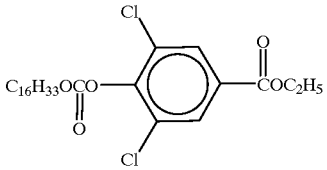
Cpd-H
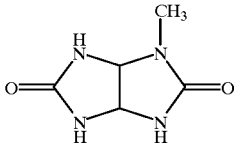
Cpd-I
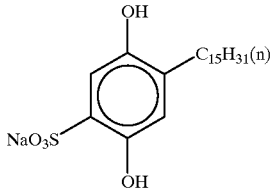

-continued
Cpd-J
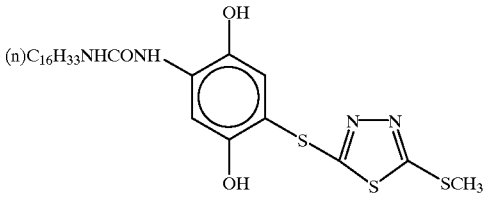
Cpd-K
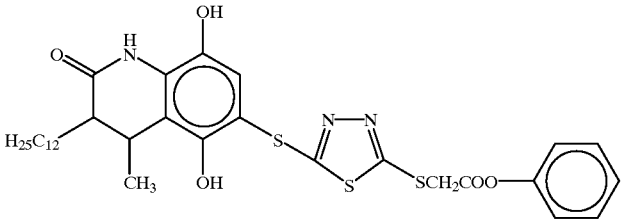
Cpd-L
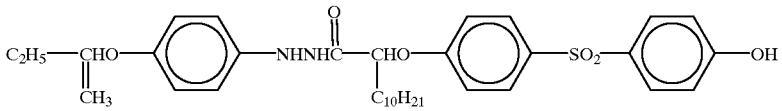
Cpd-M
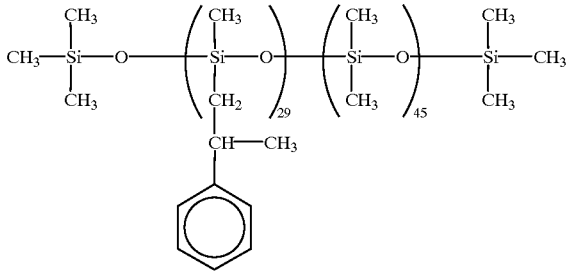
U-1
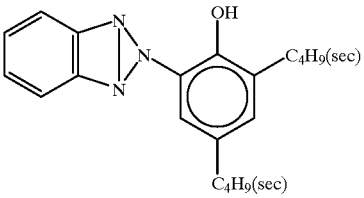
U-2
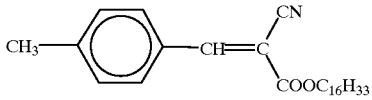
U-3
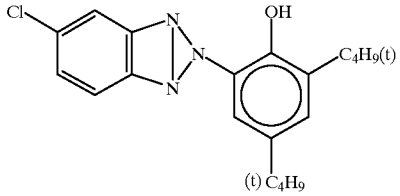
U-4
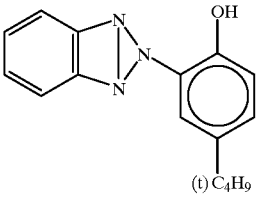
U-5
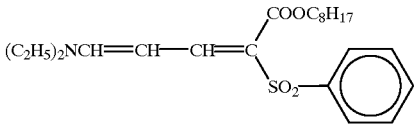

-continued
S-1
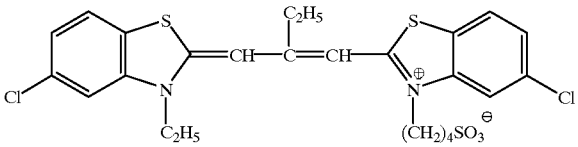
S-2
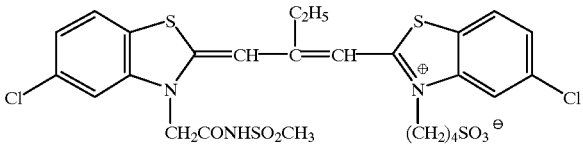
S-3
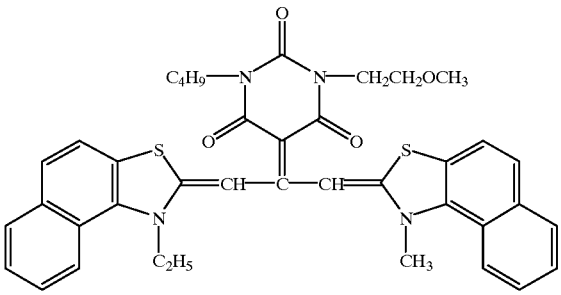
S-4
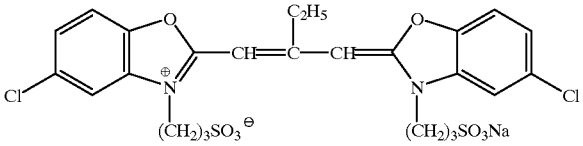
S-5
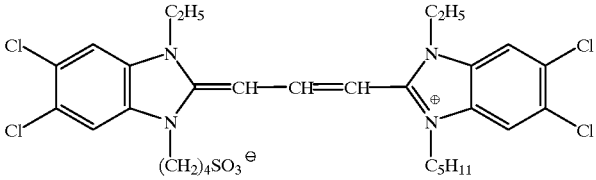
S-6
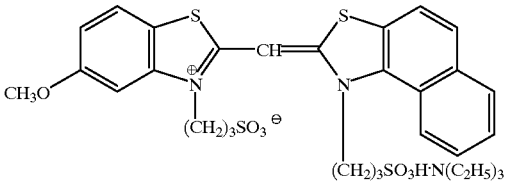
S-7
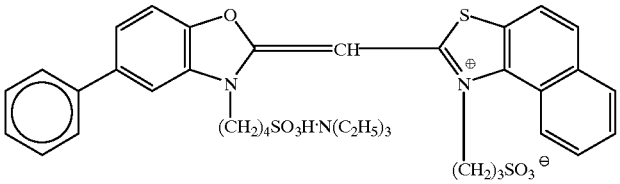
S-8
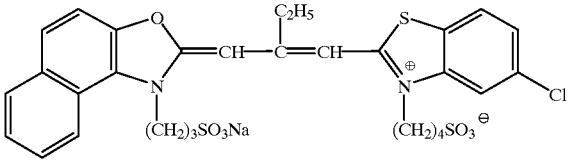
S-9
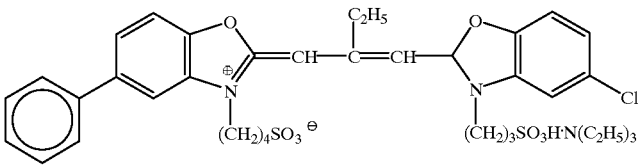

-continued
D-1
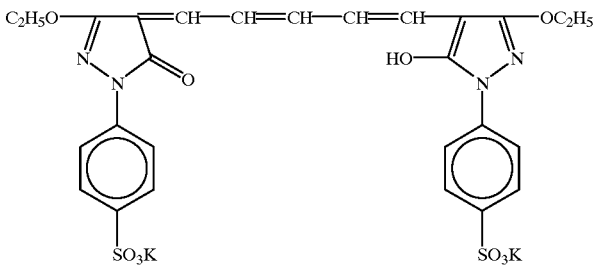
D-2
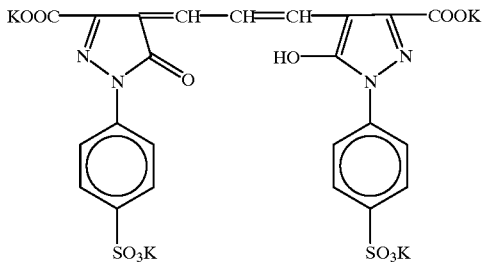
D-3
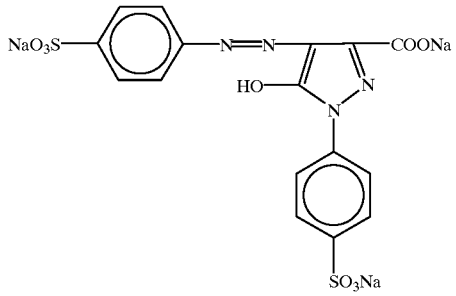
D-4
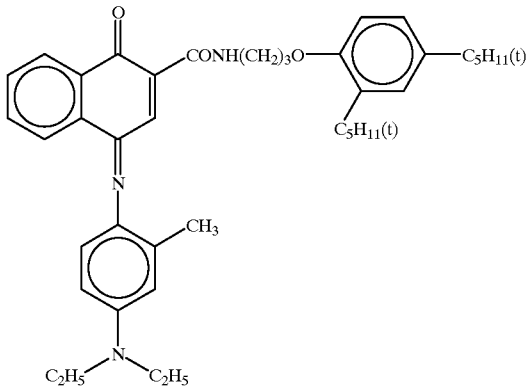
D-5
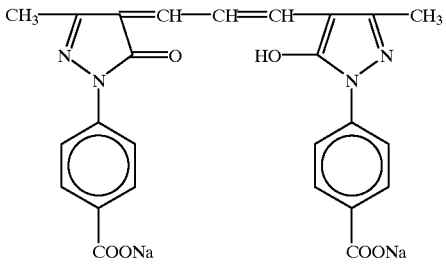

-continued
D-6
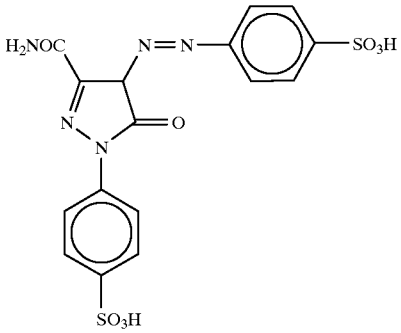
W-2
$C_8F_{17}SO_2N(C_3H_7)CH_2COOK$
W-3
$NaO_3S-CH(CH_2COOCH_2CH(C_2H_5)C_4H_9)COOCH_2CH(C_2H_5)C_4H_9$
W-4
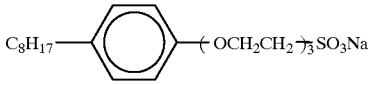
W-5
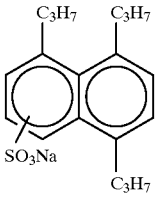
W-6
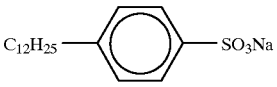
P-1
$-(CH_2-CH(CONHC_4H_9(t))-)_n-$
M-1
$-(CH_2-CH(COOC_4H_9)-)_n-$
F-1
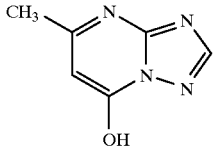
F-2
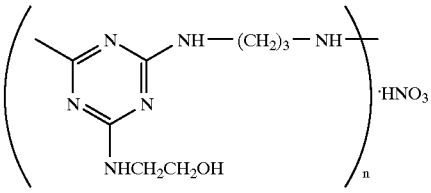
(n=3 ~ 4)
F-3
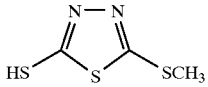
F-4
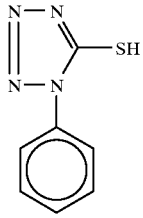

-continued

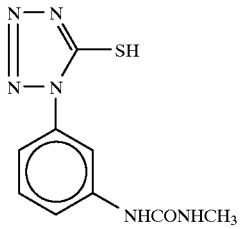

F-5

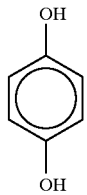

F-6

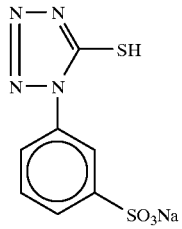

F-7

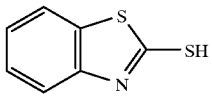

F-8

Preparation of Samples 102 to 115

First, normal crystal emulsions C-2, G-2, I-2, and J-2 corresponding to tabular emulsions C-1, G-1, I-1, and J-1 were prepared as described in Table 2 so that the sensitivity of multiple layers at standard processing became the same (The quantities of the sensitizing dyes were adjusted so as to reach the highest sensitivity).

Subsequently, silver bromide cubic grains having an average grain size of 0.15 $\mu$m were prepared by the controlled double jet method, fogged at low pAg by use of hydrazine and a gold complex salt, and then covered with shells composed of silver bromide having a thickness of 375Å at the surfaces thereof to prepare internally fogged silver bromide emulsion O.

Further, an aqueous solution containing 90 g of silver nitrate and an aqueous solution containing 64.2 g of potassium bromide were added to 300 ml of an aqueous solution containing 24 g of gelatin, 1.5 g of potassium bromide and 3.0 ml of 1N NaOH which was maintained at 30° C. over a 4-minute period. Thereafter, the reaction mixture was allowed to stand at the temperature for 10 minutes, desalted by the flocculation method, and adjusted to pH 6.5 and pAg 8.5 at 40° C. to obtain readily soluble silver bromide emulsion P with an equivalent-sphere diameter of 0.06 $\mu$m.

Samples 102 to 115 were prepared by use of these emulsions as shown in Table 4 to examine the effect of the present invention.

(Evaluation of Samples)

Samples 101 to 115 thus prepared were subjected to wedge exposure under 2000 lux for 1/50 second by use of a white light source with a color temperature of 4800 K, and then underwent the following processing.

The sensitivity of the samples in which the first development time was extended to 8 minutes was compared with that of the samples developed for 6 minutes. The sensitivity changes are shown in Table 4. The sensitivity of each color-sensitive layer was determined by the exposure amount which gave a color density of 1.0.

Further, the samples were cut to 4×5 size sheets, and a Macbeth chart was practically photographed at a color temperature of 5500 K. with 1/100 second by use of these sheets. After the first development was performed for 6 minutes and 8 minutes about the respective samples, 10 experts on photographic evaluation who work in Ashigara Research Laboratories of Fuji Photo Film Co., Ltd. rated color tint changes between the sheets processed for 6 minutes and 8 minutes. Most excellent samples were rated 1 mark and most deteriorated samples were given 10 marks. The color tint changes of the respective samples were evaluated with average marks they rated.

Further, samples 101 to 115 were subjected to step wedge exposure, and the first development was performed for 6 minutes. RMS granularity values were measured in V densities (black-and-white densities) with 48 $\mu$mΦ aperture, and values at D=1.0 are also shown in Table 4.

TABLE 4

| Sample No. | Preparation of Samples | Sensitivity Changes between 6 and 8 Minutes in First Development Time ($\Delta S_{1,0}$) Red Sensitive Layer | Green Sensitive Layer | Blue Sensitive Layer | Color Tint Changes*1 | RMS Granurality (V density × $10^{-3}$) | Notes |
|---|---|---|---|---|---|---|---|
| 101 | All emulsion layers: Tabular grains | 0.20 | 0.22 | 0.28 | 9 | 8.5 | CE*2 |
| 102 | In sample 101, the 4th layer emulsion B-1 was replaced by emulsion B-3 | 0.29 | 0.26 | 0.28 | 4 | 8.7 | PI*3 |
| 103 | In sample 102, emulsion F-1 was replaced by emulsion F-3 | 0.29 | 0.27 | 0.28 | 3 | 8.6 | PI |
| 104 | In sample 101, the 8th layer was coated with a composition further containing yellow colloidal silver (5 mg/m$^2$) | 0.20 | 0.25 | 0.29 | 8 | 8.7 | CE |
| 105 | In sample 101, the 3rd and 8th layers were coated with compositions further containing yellow colloidal silver (10 and 5 mg/m$^2$, respectively) | 0.23 | 0.25 | 0.29 | 7 | 8.7 | CE |
| 106 | In sample 103, the 8th layer was coated with a composition further containing yellow colloidal silver (5 mg/m$^2$) | 0.29 | 0.29 | 0.28 | 1 | 8.6 | PI |
| 107 | In sample 103, the 3rd and 8th layers were coated with compositions further containing yellow colloidal silver (10 and 5 mg/m$^2$, respectively) | 0.30 | 0.29 | 0.29 | 1 | 8.5 | PI |
| 108 | In sample 101, the 15th layer was coated with a composition further containing emulsion O (0.05 g/m$^2$ in terms of Ag) | 0.20 | 0.22 | 0.30 | 10 | 8.8 | CE |
| 109 | In sample 103, the 15th layer was coated with a composition further containing emulsion O (0.05 g/m$^2$ in terms of Ag) | 0.29 | 0.29 | 0.30 | 1 | 8.8 | PI |
| 110 | In sample 101, the 15th layer was coated with a composition further containing emulsion P (0.05 g/m$^2$ in terms of Ag) | 0.20 | 0.22 | 0.29 | 10 | 8.9 | CE |
| 111 | In sample 103, the 15th layer was coated with a composition further containing emulsion P (0.05 g/m$^2$ in terms of Ag) | 0.30 | 0.29 | 0.30 | 1 | 8.8 | PI |
| 112 | In the 5th, 10th, and 14th layers of sample 101, emulsions C-1, G-1, I-1, and J-1 were replaced by normal crystal emulsions C-2, G-2, I-2, and J-2 | 0.30 | 0.31 | 0.25 | 7 | 10.5 | CE |
| 113 | In the 5th, 10th, and 14th layers of sample 107, emulsions C-1, G-1, I-1, and J-1 were replaced by normal crystal emulsions C-2, G-2, I-2, and J-2 | 0.30 | 0.31 | 0.26 | 6 | 10.3 | CE |
| 114 | In sample 103, the compositions for the 15th and 16th layers were mixed, and coated | 0.30 | 0.29 | 0.32 | 3 | 8.7 | PI |
| 115 | In sample 103, the compositions for the 5th and 6th layers and for the 15th and 16th layers were mixed, and coated, respectively | 0.32 | 0.28 | 0.32 | 4 | 8.8 | PI |

*1Smaller values show smaller changes.
*2CE: Comparative Example
*3PI: Present Invention Table 4 reveals that samples 102, 103, 114, and 115 which have the constitution corresponding to claim 1 of the present invention exhibit small color tint changes and satisfactory granularity, compared to comparative examples. Further, it is clear that samples 106, 107, 109, and 111 having the constitution corresponding to claims 2 to 4 of the present invention exhibit further preferred properties.

Processing conditions are described below.

Processing steps

| Processing Steps | Time (minute) | Temperature (°C.) |
|---|---|---|
| First Development | 6 | 38 |
| Water-Washing | 2 | 38 |
| Reversal | 2 | 38 |
| Color Development | 6 | 38 |
| Pre-bleaching | 2 | 38 |
| Bleaching | 6 | 38 |
| Fixing | 4 | 38 |
| Water-Washing | 4 | 38 |
| Final Rinse | 1 | 25 |

The compositions of the processing solutions were as follows:

| First Developing Solution | | |
|---|---|---|
| Pentasodium Nitrilo-N,N,N-trimethylene-phosphonate | 1.5 | g |
| Pentasodium Diethylenetriaminepenta-acetate | 2.0 | g |
| Sodium Sulfite | 30 | g |
| Potassium Hydroquinone Monosulfonate | 20 | g |
| Potassium Carbonate | 15 | g |
| Sodium Bicarbonate | 12 | g |
| 1-Phenyl-4-methyl-4-hydroxymethyl-3-pyrazolidone | 1.5 | g |
| Potassium Bromide | 2.5 | g |
| Potassium Thiocyanate | 1.2 | g |
| Potassium Iodide | 2.0 | mg |
| Diethylene Glycol | 13 | g |
| with Water | to 1000 | ml |
| pH | 9.60 | |

The pH was adjusted with sulfuric acid or potassium hydroxide.

| Reversal Solution | | |
|---|---|---|
| Pentasodium Nitrilo-N,N,N-trimethylene-phosphonate | 3.0 | g |
| Stannous Chloride Dihydrate | 1.0 | g |
| p-Aminophenol | 0.1 | g |
| Sodium Hydroxide | 8 | g |
| Glacial Acetic Acid | 15 | ml |
| with Water | to 1000 | ml |
| pH | 6.00 | |

The pH was adjusted with acetic acid or sodium hydroxide.

| Color Developer | | |
|---|---|---|
| Pentasodium Nitrilo-N,N,N-trimethylene-phosphonate | 2.0 | g |
| Sodium Sulfite | 7.0 | g |
| Trisodium Phosphorate.12Hydrate | 36 | g |
| Potassium Bromide | 1.0 | g |
| Potassium Iodide | 90 | mg |
| Sodium Hydroxide | 3.0 | g |

-continued

| Color Developer | | |
|---|---|---|
| Citrazinic Acid | 1.5 | g |
| N-Ethyl-N-(β-methanesufoneamidoethyl)-3-methyl-4-aminoaniline.3/2Sulfate Monohydrate | 11 | g |
| 3,6-Dithiaoctane-1,8-diol | 1.0 | g |
| with Water | to 1000 | ml |
| pH | 11.80 | |

The pH was adjusted with sulfuric acid or potassium hydroxide.

| Pre-bleaching | | |
|---|---|---|
| Disodium Ethylenediaminetetraacetate Dihydrate | 8.0 | g |
| Sodium Sulfite | 6.0 | g |
| 1-Thioglycerol | 0.4 | g |
| Addition Product of Sodium Bisulfite to Formaldehyde | 30 | g |
| with Water | to 1000 | ml |
| pH | 6.20 | |

The pH was adjusted with acetic acid or sodium hydroxide.

| Bleaching Bath | | |
|---|---|---|
| Disodium Ethylenediaminetetraacetate Dihydrate | 2.0 | g |
| Ammonium Ethylenediaminetetraacetato Ferrate Dihydrate | 120 | g |
| Potassium Bromide | 100 | g |
| Ammonium Nitrate | 10 | g |
| with Water | to 1000 | ml |
| pH | 5.70 | |

The pH was adjusted with nitric acid or sodium hydroxide.

| Fixing Solution | | |
|---|---|---|
| Ammonium Thiosulfate | 80 | g |
| Sodium Sulfite | 5.0 | g |
| Sodium Bisulfite | 5.0 | g |
| with Water | to 1000 | ml |
| pH | 6.60 | |

The pH was adjusted with acetic acid or aqueous ammonia.

| Final Rinse | | |
|---|---|---|
| 1,2-Benzisothiazolin-3-one | 0.02 | g |
| Polyoxyethylene-p-monononylphenyl Ether (average polymerization degree: 10) | 0.3 | g |
| Polymaleic Acid (average molecular weight: 2000) | 0.1 | g |
| with Water | to 1000 | ml |
| pH | 7.0 | |

EXAMPLE 2

Samples 201 to 215 having the same photosensitive layers as those of samples 101 to 115 in Example 1 were prepared as follows:

1) Support

The support used in this example was prepared according to the procedure given below.

After 100 parts by weight of a commercially available polyethylene-2,6-naphthalate polymer and 2 parts by weight of Tinuvin P.326, a ultraviolet absorbing agent, (manufactured by Ciba-Geigy A.G.) were dried in the usual way, they were fused at 300° C., extruded from a T die, stretched in the machine direction to a stretch ratio of 3 at 140° C. and subsequently in the transverse direction to a stretch ratio of 3 at 130° C., and heat-fixed at 250° C. for 6 seconds, thus to obtain a PEN film with a thickness of 90 μm. Further, part of the film was wound round a stainless core tube having a diameter of 20 cm and given heat history at 110° C. for 48 hours.

2) Formation of Undercoat Layer

The above-mentioned support was subjected to corona discharge treatment, UV discharge treatment, glow discharge treatment, and flame treatment at both the sides thereof, and one of the sides was then coated with a undercoating solution with the following composition to provide a undercoat layer on the side exposed to higher temperature in the stretching described above. In the corona discharge treatment, the 30-cm-wide support was treated at a rate of 20 m/minute by use of a solid state corona treating machine model 6KVA manufactured by Pillar Corp. The treatment was found to be conducted at 0.375 KV·A/minute/$m^2$ from the readings of the current and voltage. The discharge frequency on treatment was 9.6 KHz, and the clearance between the electrode and the dielectric roll was 1.6 mm. The UV discharge treatment was conducted, while heating to 75° C. In the glow discharge treatment, irradiation was performed with an output of 3000 W for 30 seconds by use of a cylindrical electrode.

| | |
|---|---|
| Gelatin | 3 g |
| Distilled Water | 25 ml |
| Sodium α-Sulfo-di-2-ethylhexylsuccinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylolpropane-Aziridine Addition Product (1:3 in molar ratio) | 0.2 g |
| Trimethylolpropane-Toluenediisocyanate Addition Product (1:3 in molar ratio) | 0.2 g |
| Methanol | 15 ml |
| Acetone | 85 ml |
| Formaldehyde | 0.01 g |
| Acetic Acid | 0.01 g |
| Concentrated hydrochloric acid | 0.01 g |

3) Formation of Backing Layer

An antistatic layer, a magnetic sound recording layer and a slip layer having the respective compositions given below were formed as backing layers on one side of the above-mentioned support on which the undercoat layer was provided.

3-1) Formation of Antistatic Layer 3-1-1) Preparation of Conductive Finely Divided Grain Dispersion (Tin Oxide-Antimony Oxide Complex Dispersion)

Stannic chloride hydrate in 230 parts by weight and antimony trichloride in 23 parts by weight were dissolved in ethanol in 3000 parts by weight to obtain a uniform solution. 1N Sodium hydroxide solution was dropwise added to this solution until the pH of the solution reached 3, thus to obtain a coprecipitate of colloidal stannic oxide and antimony oxide. The coprecipitate thus prepared was allowed to stand at 50° C. for 24 hours to obtain a reddish brown colloidal precipitate.

The reddish brown colloidal precipitate was separated by centrifugation. The precipitate was washed with water by use of the centrifugation to remove excess ions. This water washing was preformed three times.

After 200 parts by weight of the colloidal precipitate from which the excess ions have been removed was again dispersed into 1500 parts by weight of water, the dispersion was sprayed into a furnace maintained at 650° C. to obtain a bluish, finely divided powder of a tin oxide-antimony oxide complex having an average grain size of 0.005 μm. The specific resistance of this finely divided powder was 5 Ω·cm.

A mixture of 40 parts by weight of the above-mentioned finely divided powder and 60 parts by weight of water was adjusted to pH 7.0, and coarsely dispersed with a stirrer. The mixture was then dispersed with the aid of a horizontal type sand mill (trade name: Dainomill; manufactured by Willya Bachofenag) until the residence time reached 30 minutes. These secondary aggregates had an average grain size of about 0.04 μm.

3-1-2) Formation of Conductive Layer

A conductive layer having the following formulation was applied so as to be 0.2 μm in thickness of dry membrane, and then dried at 115° C. for 60 seconds.

| | Parts by Weight |
|---|---|
| Conductive, Finely Divided Grain Dispersion Prepared in 3-1-1) | 20 |
| Gelatin | 2 |
| Water | 27 |
| Methanol | 60 |
| p-Chlorophenol | 0.5 |
| Resorcin | 2 |
| Polyoxyethylene Nonylphenyl Ether | 0.01 |

The conductive membrane thus prepared had a resistance of $10^{8.0}$ (100 V) to exhibit excellent antistatic characteristics.

3-2) Formation of Magnetic Sound Recording Layer

A magnetic material, Co-clad γ-$Fe_2O_3$ (needles, major axis: 0.14 μm, minor axis: 0.03 μm; specific surface: 41 $m^2$/g, saturation magnetization: 89 emu/g. Surface was surface-treated with aluminum oxide and silicon oxide each in an amount of 2% by weight of $Fe_2O_3$. coercive force: 930 Oe, $Fe^{+2}/Fe^{+3}$ ratio: 6/94) in an amount of 1100 g, water in an amount of 220 g, and a silane coupling agent, polyoxyethylene propyltrimethoxysilane (polymerization degree: 16) in an amount of 150 g, were well kneaded by use of an open kneader for 3 hours. This coarsely dispersed, viscous liquid was dried overnight at 70° C. to remove water, and heated at 110° C. for 1 hour to prepare surface-treated magnetic particles.

Further, the magnetic particles were kneaded again by use of the open kneader according to the following formulation.

| | |
|---|---|
| The Above Surface-Treated Magnetic Particles | 1000 g |
| Diacetyl Cellulose | 17 g |
| Methyl Ethyl Ketone | 100 g |
| Cyclohexanone | 100 g |

Furthermore, this kneaded product was finely dispersed by use of a sand mill (1/4G) at 200 rpm for 4 hours according to the following formulation.

| | |
|---|---|
| The Above Kneaded Product | 100 g |
| Diacetyl Cellulose | 60 g |
| Methyl Ethyl Ketone | 300 g |
| Cyclohexanone | 300 g |

Further, diacetyl cellulose and a trimethylolpropane-toluenediisocyanate addition product in a 1:3 molar ratio as a hardener were added thereto in amounts of 20% by weight based on the binder. The fine dispersion was diluted with a mixture of methyl ethyl ketone and cyclohexanone in the equal ratio so that the resulting liquid is about 80 cp in viscosity. The application to the above-mentioned conductive layer was performed with the aid of a bar coater so as to be 1.2 $\mu$m in thickness. The magnetic material was applied to be 0.6 g/m$^2$. Further, silica particles (0.3 $\mu$m) as a matting agent and aluminum oxide (abrasive, 0.5 $\mu$m) were also added so as to be 10 mg/m$^2$, respectively. The drying was performed at 115° C. for 6 minutes (The rollers of a drying zone and a transporting system were all maintained at 115° C.).

When a blue filter was used in status M of X-light, the increment of color density in $D^B$ of the magnetic sound recording layer was about 0.1. The saturation magnetization moment of the magnetic sound recording layer was 4.2 emu/m$^2$, the coercive force 923 Oe, and the rectangular ratio 65%.

3-3) Preparation of Slip Layer

A liquid having the following formulation was applied so that the solid components have coating amounts given below, and dried at 110° C. for 5 minutes to form a slip layer.

| | |
|---|---|
| Diacetyl Cellulose | 25 mg/m$^2$ |
| $C_8H_{13}CH(OH)C_{10}H_{20}COOC_{40}H_{41}$ (Compound a) | 6 mg/m$^2$ |
| $C_{50}H_{101}O(CH_2CH_2O)_{16}H$ (Compound b) | 9 mg/m$^2$ |

Compound a and compound b (6:9) were heated to 105° C. and dissolved in xylene and propylene glycol monomethyl ether (1:1 in volume). The resulting solution was poured into a 10-fold amount of propylene glycol monomethyl ether (25° C.) to prepare a finely divided dispersion. Further, the dispersion was diluted with a 5-fold amount of acetone, dispersed again with a high-pressure homogenizer (200 atm) to prepare a dispersion having an average particle size of 0.01 $\mu$m, and then used for coating. The slip layer obtained had a coefficient of dynamic friction of 0.06 (5 mmΦ stainless hard balls, load: 100 g, speed: 6 cm/minute) and a coefficient of static friction of 0.07 (Clip method) to exhibit excellent characteristics. The slip characteristics with emulsion layers described later were of a coefficient of dynamic friction of 0.12.

4) Formation of Photosensitive Material Layer

Layers having compositions similar to those of samples 101 to 115 in Example 1 were formed in multiple layers on the opposite side to the backing layer formed above to prepare samples 201 to 215.

The photographic materials thus prepared were cut to 24 mm (width)×160 cm, and along the longitudinal direction from a point 0.7 mm apart from one edge of the photosensitive material to the traverse direction, two 2 mm square perforations 5.8 mm apart were spaced at intervals of 32 mm. These photographic materials were put into film cartridges composed of plastics which are illustrated in FIG. 1 to FIG. 7 of U.S. Pat. No. 5,296,887.

A FM signal was recorded between the above-mentioned perforations of the photographic materials at a send speed of 100 mm/second at a head gap of 5 $\mu$m from the surfaces of the magnetic recording layer by use of an input-output-possible head with a number of turns of 2000.

After recording the FM signal, the emulsion-coated surfaces were quite uniformly exposed to light, and treated according to procedures described below. Thereafter, the photographic materials were again put into the film cartridges composed of plastics.

These samples were evaluated similarly to Example 1, and ascertained to have an effect similar to that of Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a blue sensitive emulsion layer unit, a green sensitive emulsion layer unit and a red sensitive emulsion layer unit provided on a support, at least two of said three color sensitive emulsion layer units containing at least three emulsion layers different from one another in sensitivity, in which all photosensitive layers of said three color sensitive emulsion layer units contain photosensitive tabular silver haloiodide grains having an aspect ratio of from two to 100 and said photosensitive tabular silver haloiodide grains contain grains each having a projection at at least one vertex thereof.

2. The silver halide color photographic material as claimed in claim 1, in which a light insensitive layer containing colloidal silver is formed adjacent to at least one lowest sensitivity layer of said three color sensitive emulsion layer units and wherein at least one of said three color sensitive emulsion layer units containing at least three emulsion layers different from one another in sensitivity is selected from a green sensitive emulsion layer unit and a red sensitive emulsion layer unit.

3. The silver halide color photographic material as claimed in claim 1, in which at least one of said three color sensitive emulsion layer units has an emulsion layer containing silver iodobromide grains fogged at the surfaces and/or in the interiors thereof.

4. The silver halide color photographic material as claimed in claim 1, in which said grains each having a projection at at least one vertex thereof are grains in which a vertex of an actual grain is projected out of a grain shape which is drawn in such a manner that a tangent line at the middle point of each side of the actual grain is prolonged by the distance AB where point A is a vertex of the drawn grain shape and point B is a point at which a straight line linking center of gravity G of the drawn grain shape to the vertex A intersects the edge of the actual grain, said distance AB being from 0.005 to 1 μm.

5. The silver halide color photographic material as claimed in claim 4, wherein the distance AB is 0.007 to 0.5 μm.

6. The silver halide color photographic material as claimed in claim 4, wherein each grain has at least two projections.

7. The silver halide color photographic material as claimed in claim 4, further comprising yellow colloidal silver adjacent to all of the blue sensitive, green sensitive and red sensitive emulsion layers.

8. The silver halide color photographic material as claimed in claim 7, wherein the yellow colloidal silver is present in an amount of 0.001 to 0.4 $g/m^2$.

9. The silver halide color photographic material as claimed in claim 1, in which said projection is composed of a halogen composition the silver chloride content of which is 50 mol % or less.

10. The silver halide color photographic material as claimed in claim 1, in which all of the blue sensitive emulsion layer unit, the green sensitive emulsion layer unit and the red sensitive emulsion layer unit comprise three or more emulsion layers different from one another in sensitivity.

11. The silver halide color photographic material as claimed in claim 1, wherein said aspect ratio is 5–100.

12. The silver halide color photographic material as claimed in claim 1, wherein the equivalent circular diameter of the tabular grains is 0.1 to 5.0 μm.

13. The silver halide color photographic material as claimed in claim 1, wherein the thickness of the tabular grains is 0.03 to 0.5 μm.

14. The silver halide color photographic material as claimed in claim 1, wherein the coefficient of variation in tabular grain size distribution is less than 30%.

15. The silver halide color photographic material as claimed in claim 1, wherein the content of silver iodide of the tabular grains is at least 0.2 mol %.

16. The silver halide color photographic material as claimed in claim 1, wherein the tabular grains are formed of {111} crystal faces, {100} crystal faces or mixed crystal faces of {111} and {100} crystal faces.

17. The silver halide color photographic material as claimed in claim 1, wherein the tabular grains are formed from silver iodobromide, silver iodochloride or silver iodobromochloride.

* * * * *